US009931862B2

(12) United States Patent
Murata

(10) Patent No.: US 9,931,862 B2
(45) Date of Patent: Apr. 3, 2018

(54) PRINTING UNIT AND THERMAL PRINTER

(71) Applicant: SEIKO INSTRUMENTS INC., Chiba-shi, Chiba (JP)

(72) Inventor: Tomohiro Murata, Chiba (JP)

(73) Assignee: SEIKO INSTRUMENTS INC. (JP)

( * ) Notice: Subject to any disclaimer, the term of this patent is extended or adjusted under 35 U.S.C. 154(b) by 0 days.

(21) Appl. No.: 15/225,267

(22) Filed: Aug. 1, 2016

(65) Prior Publication Data

US 2017/0036455 A1 Feb. 9, 2017

(30) Foreign Application Priority Data

Aug. 7, 2015 (JP) ..... 2015-157217

(51) Int. Cl.
*B41J 2/335* (2006.01)
*B41J 2/32* (2006.01)

(52) U.S. Cl.
CPC ..... *B41J 2/335* (2013.01); *B41J 2/32* (2013.01); *B41J 2202/31* (2013.01)

(58) Field of Classification Search
CPC ..... B41J 25/304; B41J 25/316; B41J 25/312; B41J 25/308; B41J 25/3088; B41J 25/3086; B41J 25/3084; B41J 25/3082
See application file for complete search history.

(56) References Cited

U.S. PATENT DOCUMENTS 5,594,487 A * 1/1997 Nuita ..... B41J 25/312 347/197
8,044,987 B2 10/2011 Kamata ..... 347/220

FOREIGN PATENT DOCUMENTS

JP 2008030301 2/2008

* cited by examiner

*Primary Examiner* — Kristal Feggins
(74) *Attorney, Agent, or Firm* — Bruce L. Adams; Klintworth & Rozenblat IP LLP

(57) ABSTRACT

A printing unit includes a thermal head, a platen roller, a head support member and a guide member. The platen roller is abutted against the thermal head with the recording sheet therebetween and rotated to feed the recording sheet. The head support member pivotably supports the thermal head around a pivot shaft so as to move the thermal head toward the platen roller. The head frame pivotably supports the head support member via the pivot shaft and rotatably supports the platen roller. The guide member guides the recording sheet between the thermal head and the platen roller. The thermal head and the guide member are positioned with respect to the head frame through the pivot shaft.

10 Claims, 7 Drawing Sheets

PRINTING UNIT AND THERMAL PRINTER

BACKGROUND OF THE INVENTION

1. Field of the Invention

The present invention relates to a printing unit and a thermal printer.

2. Description of the Related Art

Hitherto, a thermal printer has been known as a printer configured to perform printing on a recording sheet (heat-sensitive paper). The thermal printer includes a printing unit that can be reduced in size and weight, and has a simple configuration without using toner or ink. Therefore, the thermal printer is employed for cash registers or mobile terminal devices to be widely used to print various labels, receipts, and tickets.

As the above-mentioned printing unit, there has been known a separate-type printing unit including a head unit and a platen unit mounted to the head unit separably. The head unit mainly includes a head frame, a pivot shaft supported on the head frame, a thermal head supported on the pivot shaft so as to be pivotable, and a guide member configured to guide the recording sheet to the thermal head. The platen unit includes a platen roller configured to feed the recording sheet.

Incidentally, in the printing unit, the guide member is mounted to the head frame with fastening members, such as screws or dowels. Therefore, it may be difficult to position the thermal head and the guide member relative to each other with high accuracy depending on the dimension accuracy of the head frame or the like. Further, it is necessary to form mounting portions for the fastening members in each of the head frame and the guide member, thereby also causing a problem of leading to complication of the configuration and increase in the number of components.

In view of the above-mentioned matters, in this technical field, there have been demanded a printing unit and a thermal printer, which are capable of positioning a guide member and a thermal head with high accuracy as well as simplifying their configurations and reducing the number of components.

SUMMARY OF THE INVENTION

According to one embodiment of the present invention, there is provided a printing unit, including: a thermal head operable to perform printing on a recording sheet; a platen roller abutted against the thermal head with the recording sheet therebetween and rotated to feed the recording sheet; a head support member pivotably supporting the thermal head around a pivot shaft so as to move the thermal head toward the platen roller; a head frame supporting the head support member via the pivot shaft; and a guide member configured to guide the recording sheet between the thermal head and the platen roller, wherein the thermal head and the guide member are positioned with respect to the head frame through the pivot shaft.

In the above-mentioned printing unit according to the one embodiment of the present invention, the head support member includes: a head support wall having the thermal head fixed thereto; a pair of stays formed by respectively bending rearward both ends of the head support wall; and a coupling concave portion formed in the stays and configured to receive the pivot shaft therein.

In the above-mentioned printing unit according to the one embodiment of the present invention, the head frame has a receiving concave portion configured to receive the platen roller rotatably.

In the above-mentioned printing unit according to the one embodiment of the present invention, the pivot shaft has a release lever mounted thereto so as to be pivotable and configured to press the platen roller in a direction of removing the platen roller from the receiving concave portion.

In the above-mentioned printing unit according to the one embodiment of the present invention, the guide member has a sheet detection sensor configured to detect one of presence and absence of the recording sheet passing through the guide member.

According to one embodiment of the present invention, there is provided a thermal printer including: the printing unit; and a casing having the printing unit mounted therein.

DETAILED DESCRIPTION OF THE PREFERRED EMBODIMENTS

Embodiments of the present invention are now described referring to the accompanying drawings.

Figure 1:
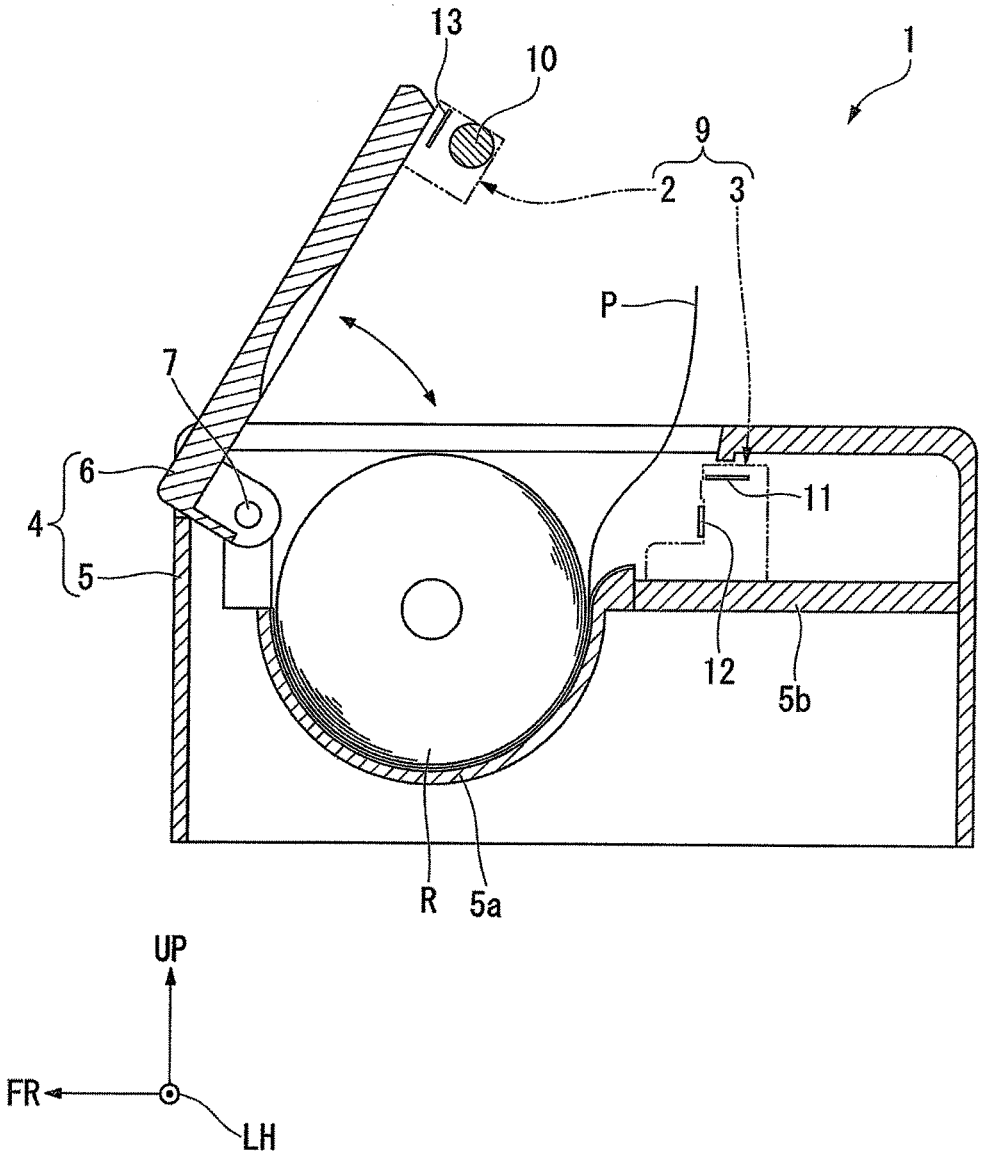
FIG. 1 is a sectional view of a thermal printer, for illustrating a state in which a printer cover is located at an opened position.
Figure 2:
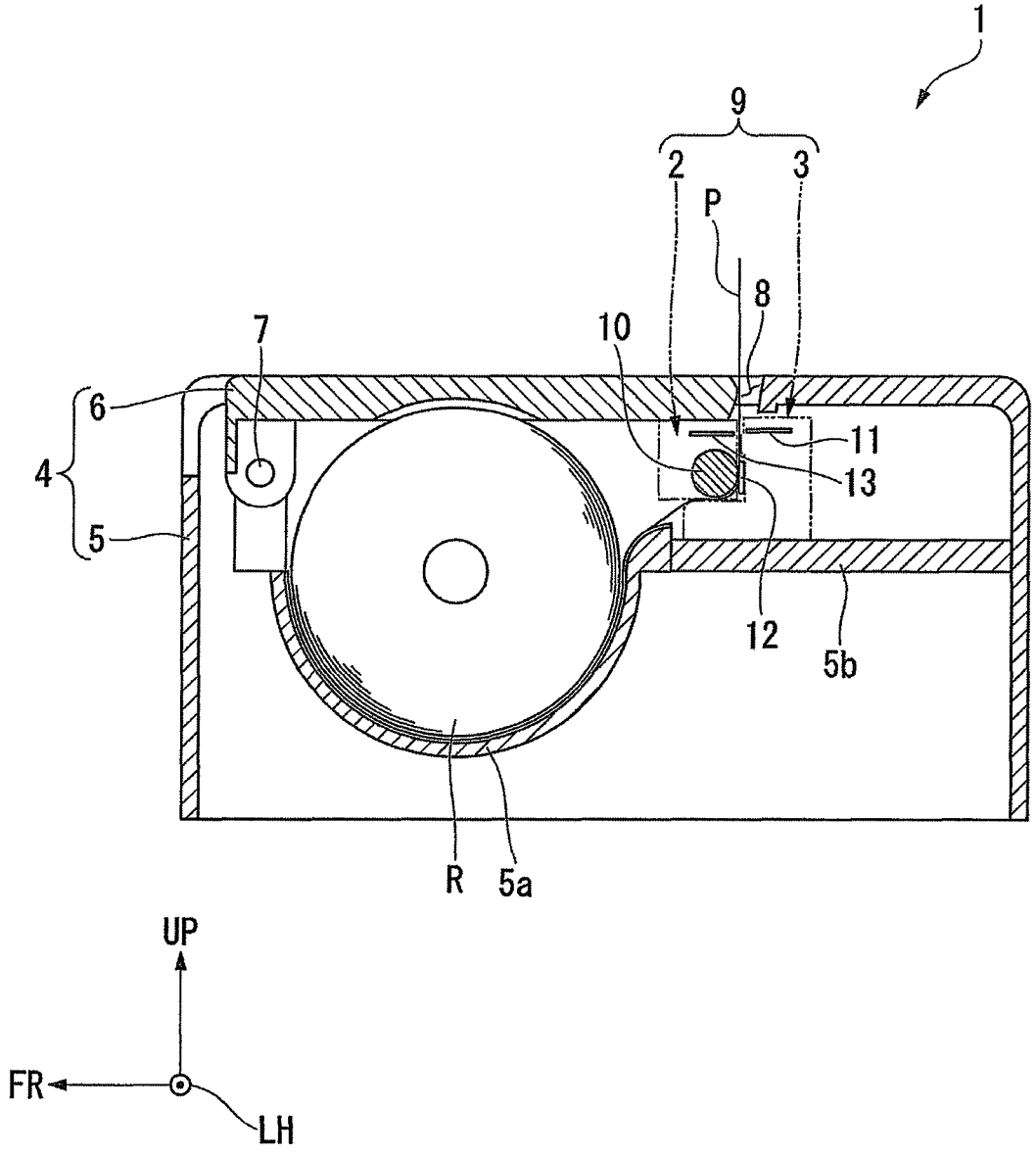
FIG. 2 is a sectional view of the thermal printer, for illustrating a state in which the printer cover is located at a closed position.

FIG. 1 and FIG. 2 are sectional views of a thermal printer 1. FIG. 1 is an illustration of a state in which a printer cover 6 is located at an opened position, whereas FIG. 2 is an illustration of a state in which the printer cover 6 is located at a closed position. In the drawings, FR represents a forward direction, LH represents a leftward direction, and UP represents an upward direction. As illustrated in FIG. 1 and FIG. 2, the thermal printer 1 of this embodiment includes a casing 4 and a printing unit 9 incorporated into the casing 4.

The casing 4 includes a casing main body 5 and the printer cover 6. The casing main body 5 includes a roll sheet receiving portion 5*a* configured to receive a roll sheet R therein. The printer cover 6 opens and closes the roll sheet receiving portion 5*a*. The roll sheet R is formed by rolling a recording sheet P. The printer cover 6 is coupled to the casing main body 5 through intermediation of a hinge portion 7 so as to be pivotable. Further, as illustrated in FIG. 2, a discharge port 8 configured to discharge the recording sheet P, which is pulled out from the roll sheet R, externally (upward) is formed between an opening edge of the roll sheet receiving portion 5*a* and a distal end of the printer cover 6 when the printer cover 6 is located at the closed position.

The printing unit 9 includes a platen unit 2 and a head unit 3 combined with each other separably. The platen unit 2 is mounted to a distal end of an inner surface of the printer cover 6. The platen unit 2 is a unit having a platen roller 10 and a fixed blade 13 mainly incorporated therein. Meanwhile, the head unit 3 is mounted in the casing main body 5. Therefore, along with an opening and closing operation of the printer cover 6, the head unit 3 is combined with the platen unit 2 separably. The head unit 3 is, for example, a unit having a thermal head 12 and a movable blade 11 mainly incorporated therein. In the example of FIG. 1, the head unit 3 is fixed to an inner plate 5*b* arranged so as to be adjacent to the roll sheet receiving portion 5*a* so that the thermal head 12 is oriented toward the roll sheet receiving portion 5*a*.

As illustrated in FIG. 2, when the printer cover 6 is closed to combine the platen unit 2 and the head unit 3 with each other, the thermal head 12 is pressed against the platen roller 10. At the same time, the movable blade 11 and the fixed blade 13 are located at a predetermined position.

Figure 3:
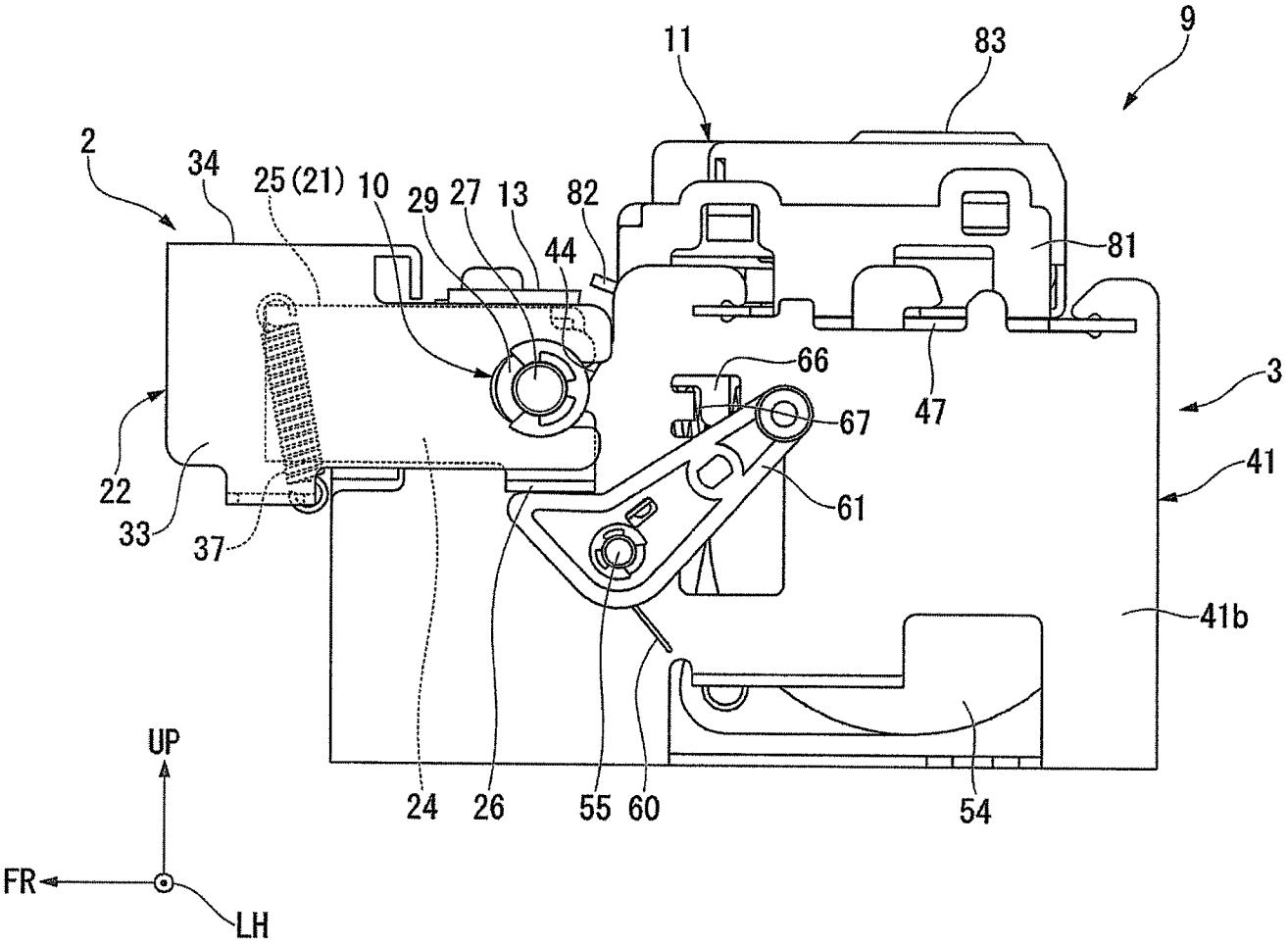
FIG. 3 is a side view of a printing unit.
Figure 4:
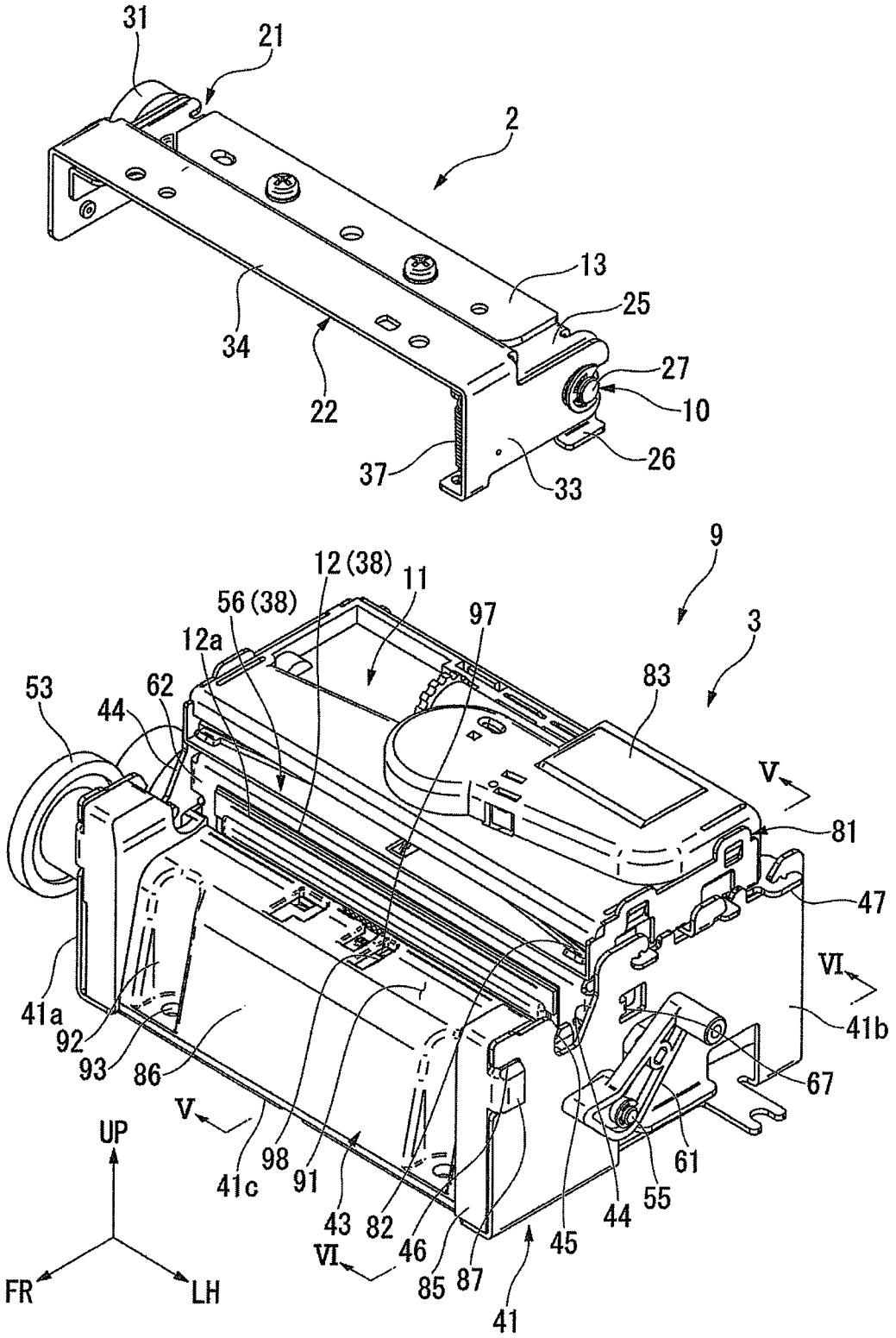
FIG. 4 is an exploded perspective view of the printing unit.
Figure 5:
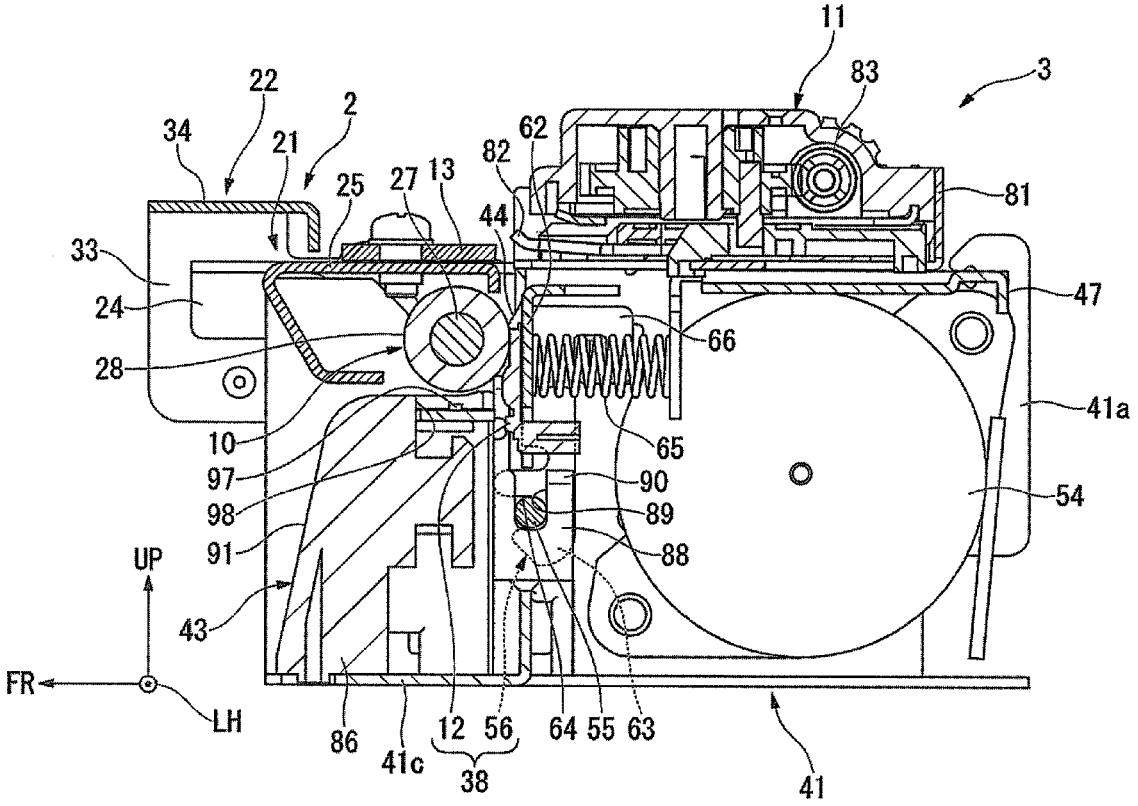
FIG. 5 is a sectional view taken along the line V-V in FIG. 4.
Figure 6:
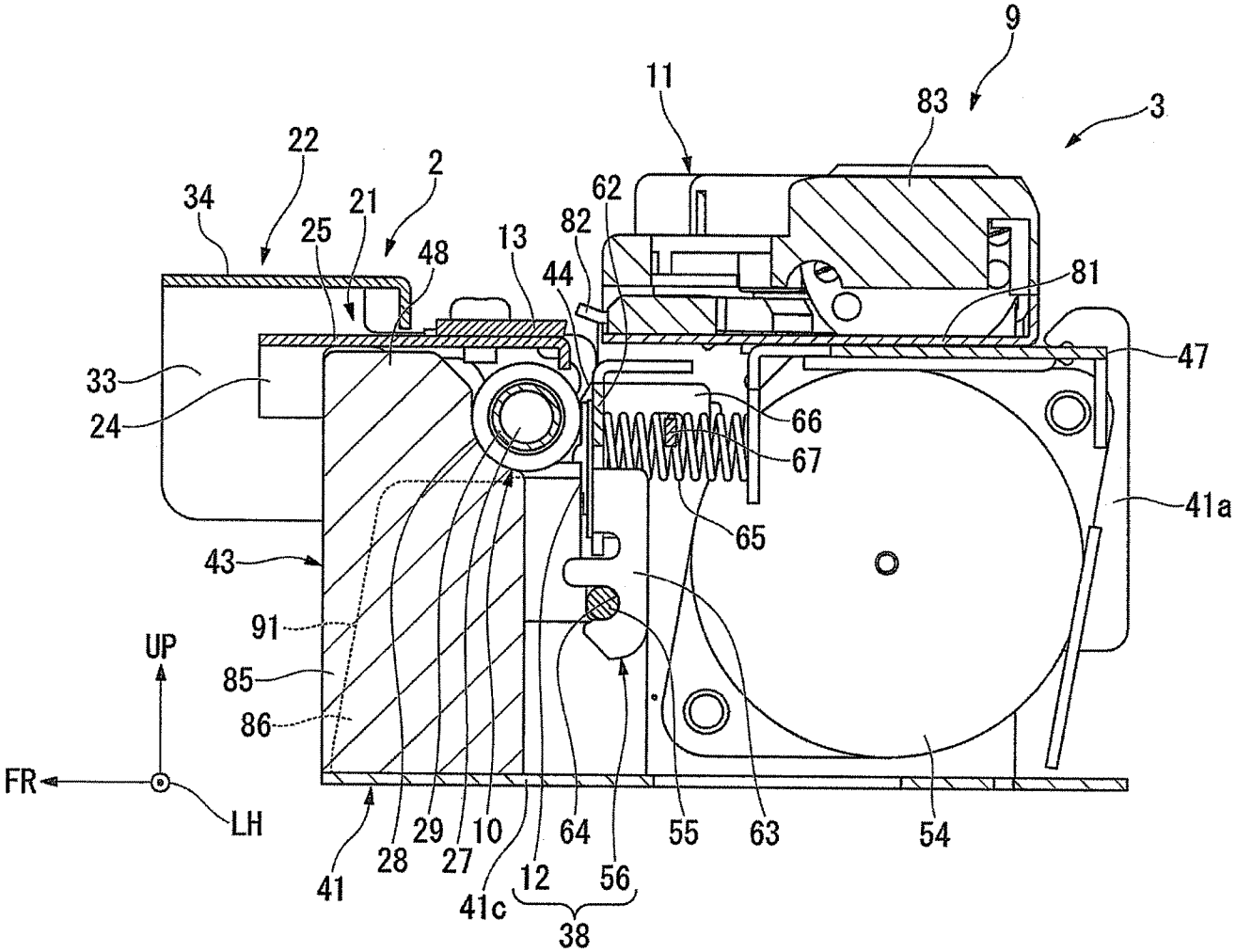
FIG. 6 is a sectional view taken along the line VI-VI in FIG. 4.

FIG. 3 is a side view of the printing unit 9, and FIG. 4 is an exploded perspective view of the printing unit 9. FIG. 5 is a sectional view taken along the line V-V in FIG. 4. FIG. 6 is a sectional view taken along the line VI-VI in FIG. 4. As illustrated in FIG. 3 to FIG. 6, the platen unit 2 includes the platen roller 10 and the fixed blade 13, which are described above, a platen frame 21, and a subframe 22. The platen frame 21 supports the platen roller 10 and the fixed blade 13. The subframe 22 supports the platen frame 21.

The platen frame 21 is formed by bending a plate material made of a metal or the like, and is formed into a U-like shape that is open downward in front view as viewed in a front-back direction. Specifically, the platen frame 21 includes a pair of shaft support portions 24 and a coupling portion 25. The shaft support portions 24 are respectively located on both ends in a horizontal direction. The coupling portion 25 extends along the horizontal direction and bridges the shaft support portions 24. A bearing 29 for the platen roller 10, which is described later, is held in a rear end of each of the shaft support portions 24. A projecting piece 26 that projects outward in the horizontal direction is formed on a lower end of one of the shaft support portions 24, which is located on one end side (left side in the illustrated example) in the horizontal direction.

The platen roller 10 is arranged so that an outer peripheral surface thereof is brought into contact with the thermal head 12 under a state in which the recording sheet P is nipped between the platen unit 2 and the head unit 3 when the platen unit 2 and the head unit 3 are combined with each other while the printer cover 6 is located at the closed position. Specifically, the platen roller 10 includes a platen shaft 27 and a roller main body 28. The platen shaft 27 extends along the horizontal direction. The roller main body 28 is made of a rubber or the like, and is mounted to the platen shaft 27.

As illustrated in FIG. 3, the bearings 29 are respectively mounted to both ends of the platen shaft 27. Each of the bearings 29 is held by the shaft support portion 24 of the above-mentioned platen frame 21. Through intermediation of the bearings 29, the platen roller 10 is rotatably supported on the platen frame 21. As illustrated in FIG. 4, a platen gear 31 is mounted to the other end (right end) of the platen shaft 27.

The fixed blade 13 is formed into a plate-like shape extending along the horizontal direction. The fixed blade 13 is fixed to the coupling portion 25 of the platen frame 21 under a state in which a cutting edge of the fixed blade 13 is oriented to the rear side.

The subframe 22 is slightly larger than the platen frame 21. That is, the subframe 22 surrounds the platen frame 21 on an upper side and both sides in the horizontal direction. Specifically, the subframe 22 includes side wall portions 33 and a base portion 34. The side wall portions 33 are located on both sides in the horizontal direction. The base portion 34 couples the side wall portions 33. The bearings 29 for the platen roller 10 are respectively inserted freely into rear ends of the side wall portions 33. The platen unit 2 is mounted to the printer cover 6 through intermediation of the subframe 22.

Between the platen frame 21 and the subframe 22, a pressure-applying mechanism 37 configured to urge (apply a pressure to) the platen frame 21 about the platen shaft 27 in a direction away from the subframe 22 (downward) is interposed. The pressure-applying mechanism 37 is formed of, for example, a coil spring extending in a vertical direction. The pressure-applying mechanism 37 is arranged at a left end of the platen unit 2. Specifically, a lower end of the pressure-applying mechanism 37 is coupled to the subframe 22, and an upper end thereof is coupled to the coupling portion 25 of the platen frame 21. It is only necessary that the pressure-applying mechanism 37 be arranged in at least one of right and left ends of the platen unit 2.

Figure 7:
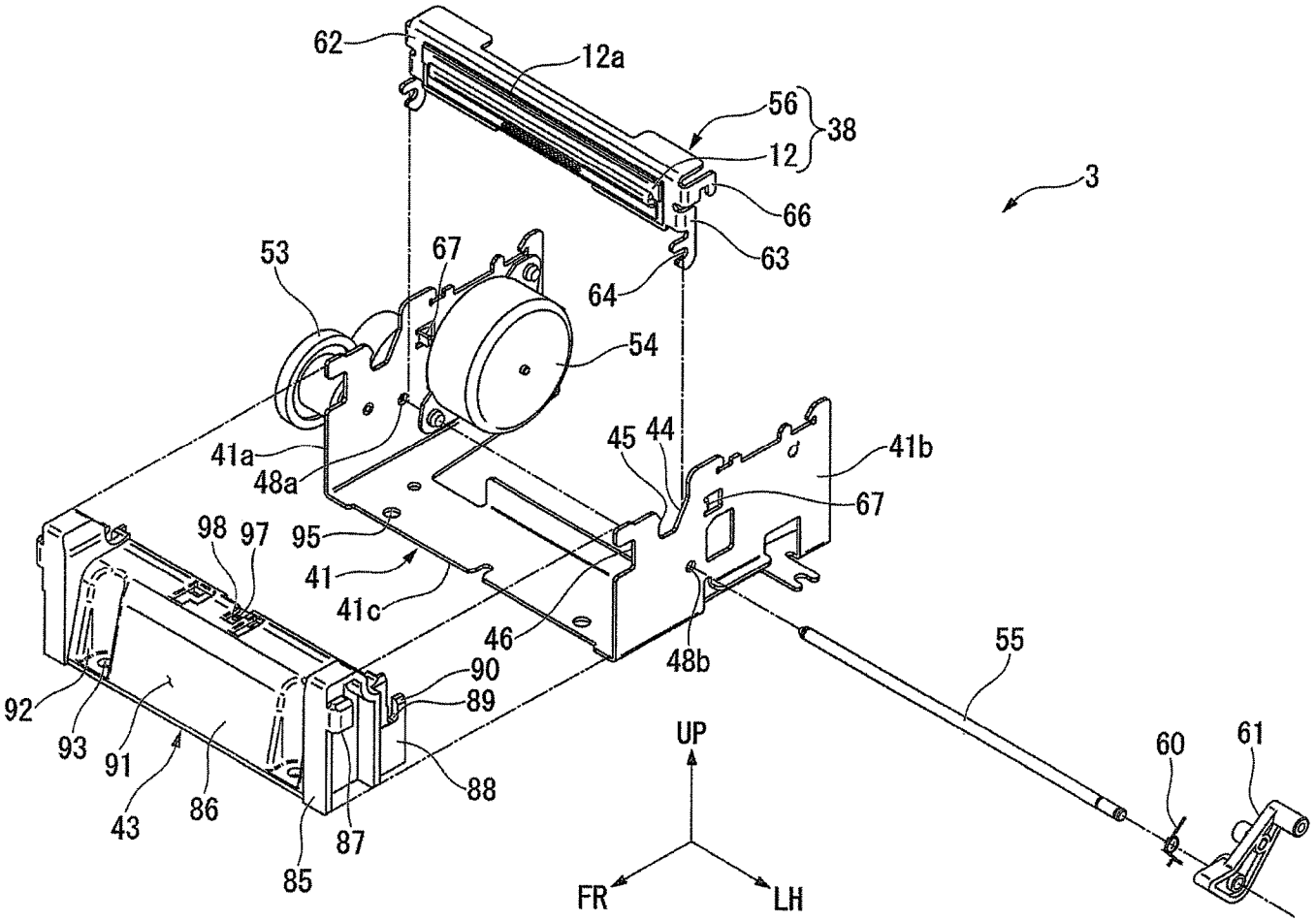
FIG. 7 is an exploded perspective view of a head unit.

FIG. 7 is an exploded perspective view of the head unit 3. The illustration of the movable blade 11 and a support member 47 is omitted in FIG. 7. As illustrated in FIG. 4 to FIG. 7, the head unit 3 includes the movable blade 11, a head block 38, a head frame 41 configured to support the head block 38 and the movable blade 11, and a guide member 43 configured to guide the recording sheet P to the thermal head 12.

The head frame 41 is formed into a U-like shape that is open upward in front view as viewed in the front-back direction. Receiving concave portions 44 are formed in a pair of side wall portions 41*a* and 41*b* of the head frame 41, which are located on both sides in the horizontal direction. The receiving concave portions 44 are open upward, and have a width along the front-back direction, which gradually decreases in a downward direction. The bearings 29 for the platen roller 10 are respectively engaged with the receiving concave portions 44. Stopper portions 45 (see FIG. 4) are formed on inner peripheral edges of the receiving concave portions 44 so as to project rearward. The stopper portions 45 are engaged with the bearings 29 for the platen roller 10 from above when the printer cover 6 is located at the closed position. As illustrated in FIG. 4 and FIG. 7, positioning concave portions 46 that are recessed rearward are respectively formed in front end edges of the side wall portions 41*a* and 41*b*.

As illustrated in FIG. 4 to FIG. 6, the support member 47 is arranged at rear parts of the side wall portions 41*a* and 41*b* (part located on the rear side with respect to the head block 38). The support member 47 has its thickness direction corresponding to the vertical direction and is arranged so as to extend in the horizontal direction. The support member 47 bridges the side wall portions 41*a* and 41*b*. The support member 47 supports the head block 38 from the rear side, and connects the movable blade 11 and the head frame 41 to each other.

As illustrated in FIG. 4, a platen gear train mechanism 53 is arranged on the side wall portion 41*a* on the right side of the side wall portions 41*a* and 41*b*. The platen gear train mechanism 53 is brought into meshing engagement with the platen gear 31 of the platen unit 2 when the platen unit 2 and the head unit 3 are combined with each other. As illustrated in FIG. 7, the platen gear train mechanism 53 is connected to a platen motor 54 mounted to the head frame 41. Through appropriate rotation of the platen motor 54, a rotating force of the platen motor 54 is transmitted to the platen gear 31 through intermediation of the platen gear train mechanism 53. As a result, the platen roller 10 is rotated.

The head block 38 includes a head support member 56 and the above-mentioned thermal head 12. The head support member 56 is supported on a pivot shaft 55 arranged in the head frame 41 so as to be pivotable about the pivot shaft 55. The thermal head 12 is fixed to the head support member 56. The pivot shaft 55 is arranged so as to extend along the horizontal direction, and both ends of the pivot shaft 55 are respectively supported in through holes 48*a* and 48*b* of the side wall portions 41*a* and 41*b*. As illustrated in FIG. 3, a release lever 61 configured to release the combination of the platen unit 2 and the head unit 3 is arranged at a portion of the pivot shaft 55, which is located on the outer side with respect to the side wall portion 41*b* on the left side.

The release lever 61 is formed into a V-like shape in side view as viewed in the horizontal direction. A corner portion of the release lever 61 is supported so as to be pivotable about the pivot shaft 55. A lever member (not shown) provided to the casing main body 5 is locked to a portion of the release lever 61, which is located on one end side with respect to the corner portion. On the other hand, a portion of the release lever 61, which is located on the other end side with respect to the corner portion, is brought into abutment against the above-mentioned projecting piece 26 of the platen frame 21 from below. In this manner, the release lever 61 pivots in conjunction with the operation of the lever member to push up the platen unit 2 through intermediation of the projecting piece 26, thereby separating the platen unit 2 from the head unit 3. An urging member 60 configured to urge the release lever 61 in a direction away from the projecting piece 26 is interposed between the release lever 61 and the side wall portion 41*b*.

As illustrated in FIG. 5 to FIG. 7, the head support member 56 is formed by bending a plate member made of a metal or the like. The head support member 56 is arranged inside the head frame 41. Specifically, the head support member 56 includes a head support wall 62 having the thermal head 12 fixed thereto, and a pair of stays 63 formed by respectively bending rearward both ends of the head support wall 62 in the horizontal direction.

The head support wall 62 has its thickness direction corresponding to the front-back direction and is arranged so as to extend in the horizontal direction. A lower end of each of the stays 63 is located at a position lower than the head support wall 62. In the lower end of each of the stays 63, a coupling concave portion 64 configured to receive the above-mentioned pivot shaft 55 therein is formed. The coupling concave portion 64 is formed into a C-like shape that is open forward in side view as viewed in the horizontal direction. With this, the head support member 56 is pivotable about the pivot shaft 55 in the front-back direction (in a direction toward and away from the platen roller 10), and is mounted to the pivot shaft 55 in a removable manner. In the illustrated example, a lower end edge of each of the stays 63 (portion located lower than the coupling concave portion 64) is tapered to be inclined downward in a rearward direction. Note that, the pivot shaft 55 may be inserted into through holes instead of the coupling concave portions 64.

A stopper engagement portion 66 is formed on each of both ends of the head support wall 62 in the horizontal direction at a portion located above each of the above-mentioned stays 63 so as to project rearward. The stopper engagement portion 66 is locked to a regulating portion 67 of the head frame 41 to restrict a pivot range of the head block 38. As illustrated in FIG. 5 and FIG. 6, a head urging member 65 is interposed between the head support wall 62 and the above-mentioned support member 47 in the front-back direction. The head urging member 65 is configured to urge the head block 38 (thermal head 12) toward the platen roller 10 (to the front side).

As illustrated in FIG. 7, the thermal head 12 is fixed to a front surface of the head support wall 62. The thermal head 12 is formed into a plate-like shape extending along the horizontal direction (sheet width direction of the recording sheet P). A plurality of heating elements 12*a* are arranged linearly on a front surface of the thermal head 12.

As illustrated in FIG. 4 to FIG. 6, the movable blade 11 is mounted to an upper part of the head frame 41 (each of the side wall portions 41*a* and 41*b*) through intermediation of the above-mentioned support member 47. Specifically, the movable blade 11 includes a movable blade frame 81, a movable-blade main body 82 supported on the movable blade frame 81 so as to be slidable, and a driving mechanism 83 configured to drive the movable-blade main body 82.

The movable blade frame 81 is formed by bending a metal plate or the like. The movable blade frame 81 is mounted on the above-mentioned support member 47 in a removable manner. A cutting edge of the movable-blade main body 82 is formed into a V-like shape in plan view as viewed in the vertical direction. That is, the movable-blade main body 82 is formed so that a length from a bottom to the cutting edge of the movable-blade main body 82 gradually decreases from both ends toward the center in the horizontal direction. The driving mechanism 83 includes a cutter motor mounted on the movable blade frame 81 so as to be rotatable in a forward direction and a reverse direction, and a gear train mechanism connected between the cutter motor and the movable-blade main body 82. When a driving force of the cutter motor is transmitted to the movable-blade main body 82 through intermediation of the gear train mechanism, the movable-blade main body 82 is slid.

As illustrated in FIG. 4 and FIG. 7, the guide member 43 is arranged between the side wall portions 41*a* and 41*b* in a front part of the head frame 41. The guide member 43 includes a pair of side blocks 85 located on both right and left sides thereof, and a guide block 86 that bridges the side blocks 85. The side blocks 85 are arranged on the inner side in the horizontal direction with respect to the side wall portions 41*a* and 41*b* of the head frame 41. Positioning protrusions 87 are formed on front ends of the side blocks 85 so as to project outward in the horizontal direction. The positioning protrusions 87 are respectively received in the positioning concave portions 46 of the above-mentioned head frame 41 from the front side. The positioning protrusions 87 are surrounded by the positioning concave portions 46 at upper, lower, and rear parts thereof.

As illustrated in FIG. 5 and FIG. 7, positioning wall portions 88 are formed on rear parts of the side blocks 85 so as to extend rearward. The positioning wall portions 88 are formed so as to extend to positions overlapping with the stays 63 of the above-mentioned head block 38, the pivot shaft 55, and the through holes 48*a* and 48*b* as viewed in the horizontal direction. The positioning wall portions 88 are located on the inner side with respect to both end surfaces of the side blocks 85 in the horizontal direction. In this case, the stays 63 of the head block 38'are arranged respectively at portions located between the positioning wall portions 88 and the side wall portions 41*a* and 41*b* of the head frame 41 in the horizontal direction.

Engagement portions 89 with which the above-mentioned pivot shaft 55 is to be engaged are formed in the positioning wall portions 88 at portions overlapping with the through holes 48*a* and 48*b* of the head frame 41 as viewed in the horizontal direction. The engagement portions 89 are each formed into a groove shape extending in the vertical direction. The engagement portions 89 are open upward at upper end edges of the positioning wall portions 88. Lower end edges of the engagement portions 89 are each formed into an arc shape that projects downward. The above-mentioned pivot shaft 55 is received inside the engagement portions 89 under a state of being brought closer to or into abutment against the lower end edges of the engagement portions 89 from above. In the positioning wall portions 88, portions located on the rear side with respect to the engagement portions 89 are lower in height than portions located on the front side with respect to the engagement portions 89. Further, tapered surfaces 90 that are inclined inward in the horizontal direction as approaching the upper side are formed on upper ends of the positioning wall portions 88.

An upper surface and a front surface of the guide block 86 are recessed downward and rearward with respect to the side blocks 85. A guide passage 91 is defined in the guide member 43 by the upper surface and the front surface of the guide block 86 and surfaces of the side blocks 85, which are located on the inner side in the horizontal direction. The recording sheet P passes through the guide passage 91 toward the thermal head 12, and the roller main body 28 of the above-mentioned platen roller 10 is received in the guide passage 91 from above when the printer cover 6 is located at the closed position. The heating elements 12*a* of the above-mentioned thermal head 12 are exposed to the inside of the guide passage 91 from the rear side.

As illustrated in FIG. 7, concave portions 92 that are recessed downward are formed in a front part of the guide block 86. The concave portions 92 are formed in both ends of the guide block 86 in the horizontal direction. In bottom wall portions of the concave portions 92, through holes 93 passing therethrough in the vertical direction are formed. The through holes 93 are overlapped with through holes 95 (see FIG. 7) formed in a bottom wall portion 41*c* of the above-mentioned head frame 41 as viewed in the vertical direction. Fastening members such as screws (not shown) are inserted through the through holes 93 and 95. The fastening members are fastened to the above-mentioned casing main body 5. Specifically, the guide member 43 is fastened to the casing main body 5 together with the head frame 41.

As illustrated in FIG. 4 and FIG. 7, in the guide block 86, there is arranged a sheet detection sensor 97 configured to detect presence or absence of the recording sheet P passing through the guide passage 91. The sheet detection sensor 97 is, for example, a reflection-type photo sensor. The sheet detection sensor 97 is exposed to the inside of the guide passage 91 through a detection window 98 formed on the guide block 86.

In the thermal printer 1 configured as described above, as illustrated in FIG. 2 and FIG. 3, under a state in which the printer cover 6 is located at the closed position and the units 2 and 3 are combined with each other, the movable blade 11 and the fixed blade 13 are arranged at a desired position, and the recording sheet P is nipped between the platen roller 10 and the thermal head 12. After passing between the movable blade 11 and the fixed blade 13, the recording sheet P is pulled out of the casing 4 through the discharge port 8. Further, the platen gear 31 on the platen unit 2 side is brought into meshing engagement with the platen gear train mechanism 53 on the head unit 3 side.

Thereafter, the platen motor 54 is driven so that the rotating force of the platen motor 54 is transmitted to the platen gear 31 of the platen unit 2. As a result, the platen roller 10 can be rotated so that the recording sheet P can be fed while the recording sheet P is nipped between the platen roller 10 and the thermal head 12. Simultaneously with the sheet feeding, various letters and figures can be clearly printed on the recording sheet P that is being fed, by appropriately allowing the heating elements 12*a* of the thermal head 12 to generate heat.

The printed recording sheet P passes between the fixed blade 13 and the movable blade 11. Then, after the passage of the recording sheet P by a predetermined length, the driving mechanism 83 is driven to slide the movable-blade main body 82 toward the fixed blade 13. In this manner, the recording sheet P can be cut between the fixed blade 13 and the movable blade 11. As a result, the recording sheet P thus cut can be used as a receipt or a ticket.

Next, as an action of the above-mentioned thermal printer 1, a method for assembling the head unit 3 is described. As illustrated in FIG. 7, first, the guide member 43 is mounted to the head frame 41. Specifically, the head frame 41 and the guide member 43 are moved so as to be closer to each other in the front-back direction under a state in which the head frame 41 and the guide member 43 are opposed to each other in the front-back direction. Then, the guide member 43 is caused to enter a part between the side wall portions 41*a* and 41*b* from the front side, and the positioning protrusions 87 of the guide member 43 are caused to enter the positioning concave portions 46 of the head frame 41. Under a state in which the guide member 43 is mounted to the head frame 41, the engagement portions 89 of the guide member 43 and the through holes 48*a* and 48*b* of the head frame 41 are overlapped with each other as viewed in the horizontal direction.

Subsequently, the pivot shaft 55 is mounted to the side wall portions 41*a* and 41*b* of the head frame 41. For example, the pivot shaft 55 is inserted through the through hole 48*b* of the side wall portion 41*b* on the left side from a right end of the pivot shaft 55, and the right end of the pivot shaft 55 is pulled out through the through hole 48*a* of the side wall portion 41*a* on the right side. As a result, the pivot shaft 55 bridges the side wall portions 41*a* and 41*b*. Stopper rings or the like (not shown) are mounted to both ends of the pivot shaft 55 at the outside of the head frame 41. Further, the pivot shaft 55 may be mounted to the head frame 41 from the right side.

While the pivot shaft 55 is being mounted, the pivot shaft 55 is caused to enter each of the engagement portions 89 of the guide member 43 from the left side. Then, after passing through the engagement portions 89 in the horizontal direction, the right end of the pivot shaft 55 is pulled out to the outside of the head frame 41 through the through hole 48*a* of the side wall portion 41*a* on the right side. As a result, the pivot shaft 55 is engaged with the engagement portions 89. Specifically, the guide member 43 is positioned with respect to the head frame 41 through intermediation of the pivot shaft 55.

Next, the release lever 61 is mounted to a left end of the pivot shaft 55. Subsequently, the head block 38 is mounted to the pivot shaft 55. Specifically, the head block 38 is inserted between the side wall portions 41*a* and 41*b* of the head frame 41 from above. At this time, the pivot shaft 55 is caused to enter the coupling concave portions 64 of the head support member 56, and the stopper engagement portions 66 are locked to the regulating portions 67 of the head frame 41. As a result, the head block 38 is supported on the head frame 41 through intermediation of the pivot shaft 55. In this embodiment, the tapered surfaces 90 are formed on the positioning wall portions 88 of the guide member 43. Therefore, widths between the positioning wall portions 88 and the side wall portions 41*a* and 41*b* of the head frame 41 gradually increase as approaching the upper side. Accordingly, the stays 63 of the head block 38 can be caused to smoothly enter clearances between the positioning wall portions 88 and the side wall portions 41*a* and 41*b* of the head frame 41.

Thereafter, the support member 47 and the movable blade 11 are mounted to the head frame 41 from above so that the above-mentioned head unit 3 is assembled. Note that, the assembly procedure for the head unit 3 may be appropriately changed.

As described above, in this embodiment, the engagement portions 89 that are engaged with the pivot shaft 55 configured to support the head block 38 are formed in the guide member 43. According to this configuration, the head block 38 and the guide member 43 are positioned by the pivot shaft 55, and hence the head block 38 and the guide member 43 can be positioned with high accuracy irrespective of the dimension accuracy of the head frame 41. In this case, the recording sheet P can be smoothly guided to the thermal head 12, thereby being capable of suppressing occurrence of paper jam or the like. Further, as compared to a configuration in which the guide member 43 is mounted to the head frame 41 using fastening members as in the related art, the number of components can be reduced. Further, as compared to a case where mounting portions for the fastening members are formed in each of the head frame 41 and the guide member 43, the configuration can be simplified.

Further, in this embodiment, the pivot shaft 55 is supported on the head frame 41, and the receiving concave portions 44 configured to receive the platen roller 10 rotatably are formed in the head frame 41. According to this configuration, the platen roller 10 and the thermal head 12 supported on the pivot shaft 55 can be positioned with high accuracy. As a result, misalignment of the platen roller 10 and the thermal head 12 can be suppressed so that the recording sheet P can be securely nipped between the platen roller 10 and the thermal head 12.

In addition, the release lever 61 is mounted to the pivot shaft 55, and hence the platen unit 2 and the release lever 61 can be positioned with high accuracy. With this, along with the operation of the release lever 61, the platen roller 10 can be securely removed from the receiving concave portions 44 so that the platen unit 2 and the head unit 3 can be easily separated from each other. As a result, excellent operability can be attained.

Moreover, the sheet detection sensor 97 is mounted in the guide member 43, and hence the sheet detection sensor 97 can be positioned with respect to the thermal head 12 with high accuracy. As a result, the detection accuracy for the recording sheet P can be enhanced.

The thermal printer 1 of this embodiment includes the above-mentioned printing unit 9, thereby being capable of providing the thermal printer 1 with high reliability, in which each of the components is positioned with high accuracy.

Note that, the technical scope of the present invention is not limited to the above-mentioned embodiment, but various modifications may be made without departing from the gist of the present invention.

For example, in the embodiment described above, the configuration in which the fixed blade 13 is provided to the platen frame 21 and the movable blade 11 is provided to the head frame 41 is described. However, the present invention is not limited thereto. Specifically, the configuration in which the movable blade 11 is provided to the platen frame 21 and the fixed blade 13 is provided to the head frame 41 may be employed.

In the embodiment described above, the case where the engagement portions 89 are each formed into a groove shape that is open upward is described. However, the engagement portions 89 are not limited thereto, and through holes or the like may be appropriately employed as long as the pivot shaft 55 is engageable therewith. In the embodiment described above, the configuration in which the engagement portions 89 are formed in the both ends of the guide member 43 in the horizontal direction (side blocks 85) is described. However, the positions of the engagement portions 89 in the horizontal direction may be appropriately changed in design. In the embodiment described above, the configuration in which the head block 38, the head frame 41, the guide member 43, and the release lever 61 are coupled to the pivot shaft 55 is described. However, the present invention is not limited thereto. Other configurations may be employed as long as at least the head block 38, the head frame 41, and the guide member 43 are coupled to the pivot shaft 55. Further, the guide member 43 only needs to be engaged with at least the pivot shaft 55, and may be supported on a portion other than the head frame 41.

Besides the above, the components in the above-mentioned embodiments may be replaced by well-known components as appropriate without departing from the gist of the present invention. The above-mentioned modified examples may be combined with each other as appropriate.

What is claimed is:

1. A printing unit, comprising:

a thermal head operable to perform printing on a recording sheet;

a platen roller abutted against the thermal head with the recording sheet therebetween and rotated to feed the recording sheet;

a head support member pivotably supporting the thermal head around a pivot shaft so as to enable the thermal head to be moved toward the platen roller;

a head frame pivotably supporting the head support member via the pivot shaft and rotatably supporting the platen roller; and a guide member configured to guide the recording sheet between the thermal head and the platen roller, wherein the thermal head and the guide member are positioned with respect to the head frame by the pivot shaft.

2. A printing unit according to claim 1, wherein the head support member includes:

a head support wall having the thermal head fixed thereto;

a pair of stays formed by respectively bending rearward both ends of the head support wall; and a coupling concave portion formed in the stays and configured to receive the pivot shaft therein.

3. A printing unit according to claim 1, wherein the head frame has a receiving concave portion configured to receive the platen roller rotatably.

4. A printing unit according to claim 3, wherein the pivot shaft has a release lever mounted thereto so as to be pivotable and configured to press the platen roller in a direction of removing the platen roller from the receiving concave portion.

5. A printing unit according to claim 4, wherein the head frame comprises a receiving concave portion configured to rotatable receive the platen roller.

6. A printing unit according to claim 1, wherein the guide member comprises a sheet detection sensor configured to detect one of presence and absence of the recording sheet passing through the guide member.

7. A printing unit according to claim 6, wherein the head support member includes:

a head support wall having the thermal head fixed thereto;

a pair of stays formed by respectively bending rearward both ends of the head support wall; and a coupling concave portion formed in the stays and configured to receive the pivot shaft therein.

8. A printing unit according to claim 6, wherein the pivot shaft has a release lever mounted thereto so as to be pivotable and configured to press the platen roller in a direction of removing the platen roller from the receiving concave portion.

9. A thermal printer, comprising:

the printing unit of claim 8; and a casing having the printing unit mounted therein.

10. A thermal printer, comprising:

the printing unit of claim 1; and a casing having the printing unit mounted therein.

* * * * *